US006311687B1

(12) United States Patent
Aidelsburger

(10) Patent No.: US 6,311,687 B1
(45) Date of Patent: Nov. 6, 2001

(54) HEATING FURNACE, ESPECIALLY WITH GAS AND/OR OIL FIRING

(76) Inventor: Johann Aidelsburger, Winden 8, D-86556 Kuhbach (DE)

( * ) Notice: Subject to any disclaimer, the term of this patent is extended or adjusted under 35 U.S.C. 154(b) by 0 days.

(21) Appl. No.: 09/554,979

(22) PCT Filed: Nov. 20, 1998

(86) PCT No.: PCT/DE98/03434

§ 371 Date: May 22, 2000

§ 102(e) Date: May 22, 2000

(87) PCT Pub. No.: WO99/27310

PCT Pub. Date: Jun. 3, 1999

(30) Foreign Application Priority Data

Nov. 23, 1997 (DE) ..... 197 51 794
Nov. 28, 1997 (DE) ..... 197 52 699

(51) Int. Cl.[7] ..... F24C 3/00
(52) U.S. Cl. ..... 126/512; 126/91 R; 126/400
(58) Field of Search ..... 126/400, 273.5 R, 126/58–76, 248, 85 R, 144, 147, 151.91 R, 500, 116, 92 R, 92 AC, 92 C; 165/104.14

(56) References Cited

U.S. PATENT DOCUMENTS 1,362,789 * 12/1920 Hamilton ..... 126/92 C
1,497,345 * 6/1924 Pasichnik ..... 126/58
2,277,340 * 3/1942 Magiera ..... 126/70
4,248,204 * 2/1981 Rowe ..... 126/400
4,270,512 * 6/1981 Van Der Maas ..... 126/400

FOREIGN PATENT DOCUMENTS 3 76 787 12/1984 (AT) ..... F24B/1/06
26 50 053 5/1978 (DE) ..... F24C/1/02
33 41 481 5/1985 (DE) ..... F24B/7/04
35 00 186 7/1985 (DE) ..... F24C/15/34
35 01 289 9/1986 (DE) ..... F24B/1/04
36 00 982 7/1987 (DE) ..... F24B/7/04

* cited by examiner

*Primary Examiner*—James C. Yeung
(74) *Attorney, Agent, or Firm*—Darby & Darby

(57) ABSTRACT

The invention relates to a heating oven (1) in particular with a gas and/or oil firing system. The heating oven comprises a combustion chamber (2) surrounded by heat storage elements, wherein respective first heat storage elements (3, 4; 27) are arranged at a first spacing parallel to respective walls (5, 6; 27) of the combustion chamber (2). Second heat storage elements (12, 14; 25) are arranged at a second spacing parallel to the respective outside of the first heat storage elements. The first spacing defines a first air channel (16, 17; 28) and the second spacing defines a second air channel (15, 18; 26) in each arrangement. The air in the first channel is heated by the walls of the combustion chamber, rises, cools down on the surrounding storage elements and sinks downwardly in the second air channel while giving up further energy to the heat storage elements. Thereafter, the cooled air again reaches the first air channel and the described flow cycle begins again in the heat exchanger.

26 Claims, 5 Drawing Sheets

HEATING FURNACE, ESPECIALLY WITH GAS AND/OR OIL FIRING

BACKGROUND OF THE INVENTION

1. Field of the Invention

The invention relates to a heating oven according to the with an air-tight combustion chamber including a fresh air inlet and an exhaust gas outlet. The heating oven also includes at least one first heat storage element, which is heated by the combustion chamber and at least for the most part spaced apart from the combustion chamber, such that an air channel or a first flow channel is defined by the spacing.

2. Description of the Related Art

In known wood-burning tile stoves, the heat from wood combustion is supplied to heat storage means. To obtain good heat exchange between the hot exhaust gases from combustion and the refractory bricks of the heat storage means, it is known to deflect the hot combustion gases through the heat storage means to, by passing the bricks in the stove several times before the gases; reach the chimney.

Wood-burning tile stoves are very popular because the heating effect is considered very pleasant. The air is not heated, rather the walls and all other solid objects in the room are heated by radiation. In addition, air circulation is largely avoided, which means that no additional dust fills the air. Moreover, the air humidity and the balance between positive and negative ions are maintained which leads to a healthy, natural climate.

Wood-buming tile stoves have the disadvantage that the amount of wood necessary for operation requires considerable storage space. Such space is often unavailable especially in town houses on small lots or in multiple family dwellings.

German patent application DE 26 50 053 A1 discloses an oven having a heat retaining material surrounding the combustion chamber, which is operated with liquid or gaseous fuels. The encasing of the combustion chamber with heat retaining materials, especially chamotte, has the purpose of retaining the heat from the combustion process and continuous radiation of the heat.

A considerable amount of moisture forms from the combustion of the heating gas, in particular from natural gas, city gas, liquid gas (propane, butane, etc.) or heating oil. Further, DE 26 50 053 A1 discloses that the heat retaining material is disposed in direct contact with the combustion chamber, such that the combustion heat is immediately transferred to the heat retaining material. Thus, the combustion chamber only slowly reaches its final temperature, which remains far below 100° C. A temperature of 100° C. or possibly higher should also be avoided so that the operator does not suffer burns from the heat retaining material. However, this results into moisture condensation from the combusted gases on the walls of the combustion chamber. The combustion chamber corrodes, is no longer air-tight, the heat retaining material becomes sooted and the oven releases moisture via the heat retaining material into the room to be heated.

The German patent application DE 35 00 186 A1 discloses a heat retaining system for wood-fired heating stoves. The reference discloses that conventional ceramic retaining materials, such as chamotte, have poor thermal conductivity properties. With increasing thickness of the brick walls, in order to increase the retaining capacity, the heat release is increasingly delayed. To achieve a more rapid and a correspondingly good heat exchange, even with higher retaining capacities, i.e. thicker walls of the retaining medium, it is suggested to embed metal heat conducting elements into the retaining material. Further, air channels are provided in the side of the heat retaining material facing the combustion chamber, through which hot exhaust gases are guided to the chamotte or fireclay bricks of the heat retaining material by means of convection from the combustion chamber. Thus, the heat supply from the combustion chamber to the material is improved.

Should such a wood-burning tile stove be operated with gas, the heat retaining would become sooted because the moisture from the combustion gas would reach the heat retaining. Thus, the wood-burning stove of DE 35 00 186 A1 would not be suited for heating with gas or oil.

The German patent application DE 36 00 982 A1 discloses a wood-burning tile stove suited for hot air heating. A heating assembly is provided with a back wall arranged directly on the wall of the room, so that the thermal energy of the heating assembly is passed directly to the (cold) wall. It is suggested to arrange retaining bricks directly on the wall of the heating assembly in order to obtain a fast response with high retaining capacity of this tile stove.

Similar to the statements on DE 26 50 053 A1, wherein-the heating assembly is arranged on the wall of the heated room alone has the consequence that the assembly does not reach a temperature of 100° C. This temperature reduction is enhanced by the retaining bricks arranged thereon. Should this known tile stove be operated with gas, moisture would condense on the heating assembly and on the retaining bricks. Consequently, water would flow out of the stove.

Finally, the Austrian patent AT 376 787 discloses a wood-burning tile stove, which is available in prefabricated form, the work-initensive setting of the tiles is to be avoided. This is achieved by providing a dual-casing arrangement. The space between the inner casing and the outer casing is filled with heat-storing material only in the region where the walls face the room to be heated. The remaining region has lower air intakes and upper air outlets for the heated air. A particular disadvantage of this wood-burning tile stove is that the lower inflowing and the upper out flowing air produces a very unfavourable air draft in the room to be heated. The concept of such wood-buming stoves however is precisely that the heat should only be radiated from the stove to the surroundings. In addition, the known convection tile stove has a reduced heat retaining capacity due to the smaller volume of the retaining material. This known stove is therefore not capable of delivering heat over a longer time after the wood fire has been extinguished. Moreover, this known stove is neither suited for nor intended to be operated with gas or oil.

The German patent application DE-A 1 33 41 481 discloses a wood-burning tile stove. To achieve a rapid heating up of the room containing the stove, the firing chamber is completely surrounded by convection channels so that the air flowing directly along the chamber walls is greatly heated and can be passed as an air flow to the room. Despite good heat discharge, the outer walls of the oven opposed to the firing chamber become only moderately warm due to the strong convection flow.

Even if one operated the convection wood-burning tile stove of DE-A 1 33 41 481 with gas or oil, although no suggestion of same is given, the water vapor resulting from the combustion of gas or oil would condense on the walls of the combustion chamber. This is because the air flowing by the chamber walls is strongly heated, which self-evidently leads to a cooling of the chamber and prevents its temperature from rising above 100° C.

A particular object of the present invention is to provide a functional heating oven for gaseous or liquid fuels, which has a large heat retaining capacity despite its compact form.

SUMMARY OF THE INVENTION

The heating oven according to the invention is provided with a combustion chamber which is substantially air-tight with respect to its surrounding heat-retaining elements, so that the exhaust gases and moisture resulting from the combustion of a heating gas or liquid fuel cannot reach the heat-storing elements or retaining bricks. The term heating gas will be understood to include in particular natural gas, city gas, liquid gas (propane and butane, etc.) and oil will be understood to include in particular heating oil, lower alcohols, in particular methanol and ethanol, and lower natural alcohols, in particular rape oil. These fuels as well as wood and coal are suited for use in the heating oven of the present invention.

Heat exchangers are provided to transfer the heat from the combustion chamber to the heat storing elements or refractory bricks. The heat exchanger according to the invention includes at least one wall of the combustion chamber, an air channel and one heat retaining element or brick. The air between the inside of the retaining element and the wall of the combustion chamber is heated at the wall of the combustion chamber and flows upwardly in the air channel. The thermal energy of the wall of the combustion chamber is transferred to the opposing retaining element both by convection and radiation. In one embodiment of the invention, a flat element is provided as the retaining element, which is so arranged in the present heating oven such that its extended inner surface lies parallel to the wall of the combustion chamber, which is naturally also flat.

According to a preferred embodiment of the present invention, a second heat exchanger is provided adjacent the first heat exchanger toward the outside of the heating oven. The second heat exchanger is composed of the outer side of the heat retaining element, a second air channel and an inner side of the heating oven. In this embodiment, the air heated on the combustion chamber wall rises in the first air channel, arrives at further, cooler retaining elements of the oven and transfers heat thereto. In the process, the heated air then cools and sinks downwardly into the second air channel while giving up further heat to the wall of the oven. The cooler air at the bottom then heats up again on the combustion chamber wall and the cyclic process begins again.

According to a further embodiment of the invention, the above arrangement is not only provided on a single wall combustion chamber but on all of the walls.

In an inexpensive embodiment of the present heating oven, the combustion chamber is provided with large substantially flat outer surfaces and/or with flat elements for heat retaining. Preferably, the combustion chamber is substantially box-shaped.

To achieve good heat transfer from the hot combustion gases to the combustion chamber, one embodiment of the invention comprises means in the combustion chamber for single or multiple deflection of the combustion gas. In a preferred embodiment, the combustion chamber is made of metal or sheet metal and the means for gas deflection consists of metal plates or sheets, by which the gas is directed to the chimney. Clearly, a combustion chamber can also be made of other materials, such as refractory bricks.

In a further embodiment of the present invention, means for single or multiple flue gas deflection are provided in the gas outlet of the combustion chamber. These deflection means are advantageously arranged in the heating oven of the present invention. The hot combustion gases remain in the heating oven longer, and the efficiency of the oven is improved. In addition, one or more heat retaining elements can also be provided in the region of this flue gas deflection. To achieve improved heat retaining, the above-mentioned heat exchanger arrangement according to the invention can also be provided in the region of flue gas deflection.

In a further embodiment of the invention, one or more heat conduction elements are provided in the flow or air channel between the combustion chamber wall and the first heat retaining element, which conduct heat from the chamber wall toward the retaining element. Preferably, the conduction element has a completely or partially corrugated structure and is arranged in the air channel such that a plurality of flow channels are formed. These are arranged for example to be transverse or perpendicular to the flow direction, such that air flows from below to above across the channels. Preferably, the corrugated structure is formed of metal or sheet metal and is attached to the wall of the combustion chamber. Preferably, the heat conduction element is at least partially blackened to provide good heat transfer between the conduction elements and the passing air.

In a further embodiment of the present invention, the heat conduction element arranged in the air channel is configured to be spaced apart from the heat retaining element. If desired however, the conduction element can also be configured to be partially or completely in contact not only with the combustion chamber wall but also with the side face of the retaining element opposing the combustion chamber wall. When the conduction element has the described corrugated structure, the resulting flow channels can be arranged vertically, such that air can still flow through the air channel.

The conduction element can be provided with a substantially flat plate on its side facing the retaining element or opposing the combustion chamber wall in order to allow easy assembly of the conduction element in the flow or air channel.

According to a further embodiment of the present invention, a second heat conduction element is disposed in the flow or air channel between the first retaining element and the second retaining element. The arrangement is analogous to that of the conduction element in the first air channel. Preferably, the second conduction clement has the same structure as described above.

In a preferred embodiment of the invention, the first retaining element and/or the second retaining element are arranged substantially parallel to the combustion chamber wall and/or have substantially the same dimensions as the corresponding wall of the combustion chamber. Preferably, the first and/or second heat retaining element have substantially the form of a flat plate. Particularly the first retaining element is rounded at its upper and/or lower ends to achieve good flow properties.

In a preferred embodiment, the first and/or second retaining element has a thickness of about 30 mm to 120 mm and/or has the form of a flat body. Preferably, the first retaining element, i.e. the one closer to the combustion chamber wall, is thicker than the second retaining element, preferably it is twice as thick.

In a further embodiment of the present invention, the first retaining element and/or the second retaining clement and/or the combustion chamber wall as well as the gas deflection means are completely or partially formed of refractory brick, in particular steatite or chamotte or a material having a high heat retaining capacity and a sufficient temperature resistance.

In a further embodiment, one or more temperature sensors are provided, in the interior and/or externally from the heating oven, such as temperature dependent resistors. These are connected to a combustion controller by means of at least partially temperature resistant electrical wires. In addition, a temperature sensor for measuring the temperature outside of the house can be employed, where the measurement is used in controlling combustion. It is possible to shut down combustion when sufficient heat is stored for a given outside temperature. In the case of gas or oil operation, a valve can be regulated by the controller so as to open when the temperature falls below a first lower temperature to initiate combustion. When reaching a second higher temperature, the valve can be closed and combustion shut down.

Alternatively, or in addition to the above, a thermostat with a temperature sensor can be located in the room, which compares the actual room temperature with a predetermined set temperature. The result is supplied to the controller such that the oven heats up if the temperature is below the set temperature and the operation is shut down upon reaching the set temperature.

In a further embodiment, an electronic simulation means is provided, which simulates the cracking and popping sound of burning wood. Preferably, the simulation means comprise a semiconductor memory which stores a corresponding sound sequence or several sequences. The stored sequence or sequences are amplified and supplied to a loudspeaker.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWING

An embodiment of the heating oven according to the present invention is described in more detail in the following, in conjunction with the drawings which are not necessarily to scale, where the same or similar elements have the same reference numerals.

DETAILED DESCRIPTION OF THE PRESENTLY PREFERRED EMBODIMENTS

Figure 1:
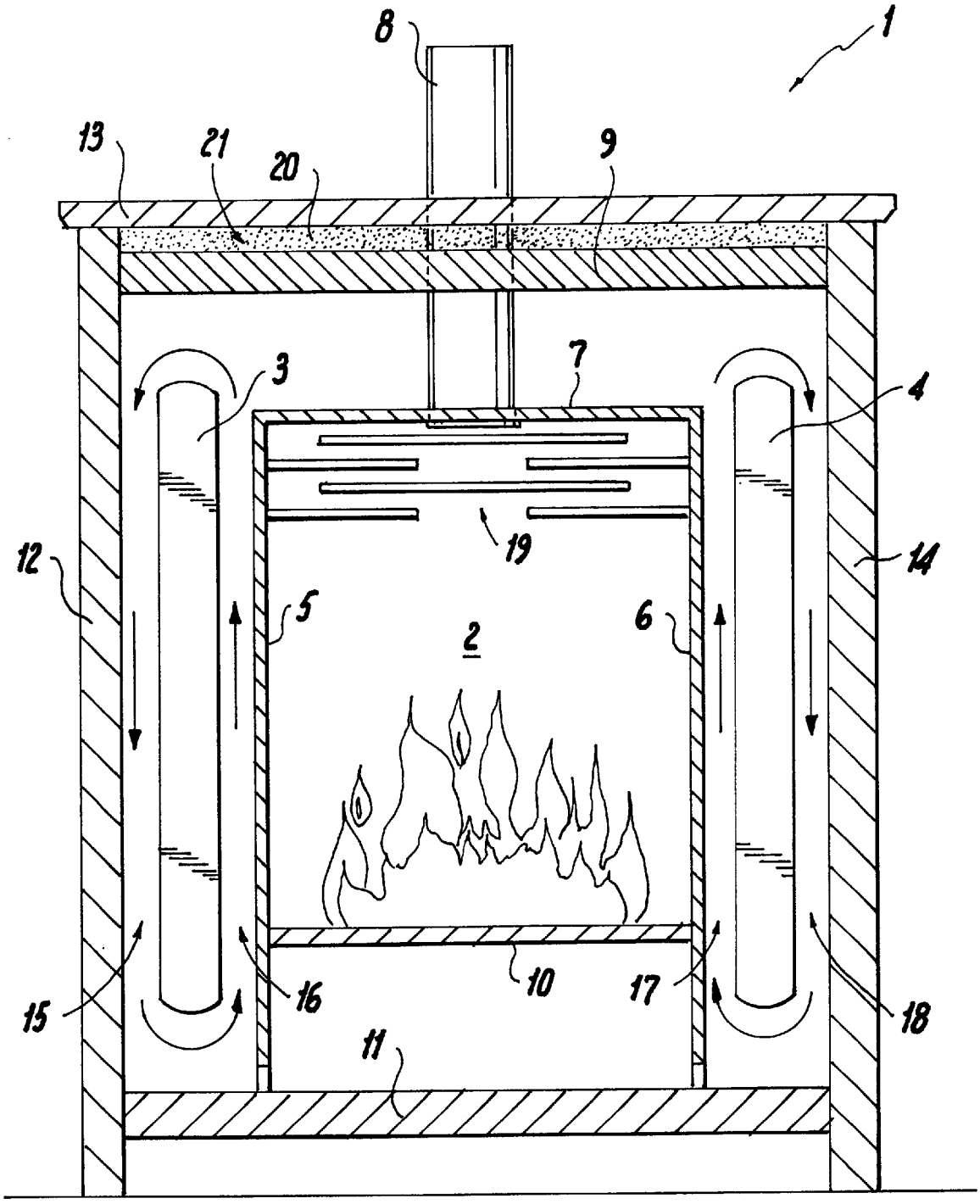
FIG. 1 shows a front view in cross-section of a gas-fired heating oven according to the invention and a heat retaining means.

FIG. 1 shows a heating oven according to the invention in front view and longitudinal cross-section. The oven 1 comprises a combustion chamber 2 surrounded by a sheet metal mantle and two vertically arranged flat retaining elements 3 and 4 running parallel to the left and right walls 5 and 6 of the chamber 2. The upper wall 7 comprises a flue gas outlet 8. A flat retaining element 9 is provided above and parallel to the upper wall 7. A flat retaining element 11 is arranged below the lower wall 10. The retaining elements 3, 4 and 9 are surrounded by flat retaining elements 12, 13 and 14 together with the retaining element 11 such that they completely enclose the combustion chamber 2 and the inner retaining elements 3, 4 and 9.

The retaining element 3 is arranged between the left outside retaining element 12 and the left wall 5 of the combustion chamber 2 such that a spacing is defined between the element 3 and the outer retaining element 12 as well as between the retaining element 3 and the wall 5 of the combustion chamber 2. The element 4 is also arranged between the outer retaining element 14 and the right wall 6 of the combustion chamber 2, where a spacing is defined between the retaining element 4 and the right outer retaining element 14 as well as between the retaining element 4 and the right wall 6 of the combustion chamber 2.

The mentioned spacings define the left air channels 15 and 16 as well as the right air channels 17 and 18. The combustion chamber 2, fired for example with gas, has the hot walls 5 and 6, which heat up the air in the inner channels 16 and 17 and the corresponding opposing flat retaining elements 3 and 4. The heated air flows upwardly as indicated by the arrows. Having reached the top, upward flow is prevented by the retaining elements 9 or 13.

While transferring thermal energy to the surrounding retaining elements, the heated air reaches the outer elements 12, 13 and 14 and is cooled by transferring further heat and flows into the outer air channels 15 and 18 and then downwardly as shown by the arrows. Towards the bottom, further airflow is restricted by the flat retaining element 11 and the cooled air passes into the air channels 16 and 17, where the flow circulation begins again.

Instead of a gas operation, the combustion can be with oil, coal or wood as well as with a suitable combination of the mentioned fuels.

The combustion chamber 2 is preferably made of metal, in particular sheet metal such as steel or refined steel sheets. Since the retaining bricks or retaining elements surrounding the combustion chamber are arranged at a spacing from the chamber, the walls of the combustion chamber rapidly reach a temperature of about 100° C. and more. This is achieved according to the invention in that the combustion chamber such as a sheet metal chamber is employed, which has low mass or heat retaining capacity. With these measures for rapid heating of the combustion chamber walls, it is achieved that water vapour resulting firm the combustion of gas, oil, coal, wood, etc. after a short time can no longer condense on the walls of the chamber, i.e. after the combustion chamber walls have reached a temperature of over 100° C. The water vapour is discharged via the flue gas outlet of the oven. The collection of water in the present oven is therefore effectively avoided. This can be further guaranteed by employing a combustion controller for rapid heating to about 100° C. (for example by initially setting the maximum combustion rate). Subsequently the combustion rate can be regulated, also in steps, back to the set temperature for the oven or for the room to be heated.

It will be understood that the combustion chamber can be fabricated from refractory bricks or other materials instead of metal, sheet metal, etc., as long as it can be achieved with a low wall thickness that the chamber walls will rapidly heat up to a temperature of about 100° C.

The combustion chamber is preferably air-tight with respect to exhaust gases. This avoids the combustion gases or moisture resulting from combustion coming into contact with the retaining bricks or entering into the room to be heated.

According to the invention, the combustion chamber 2 is provided with gas deflection means 19 in the area of the exhaust gas outlet 8. A spacing is also provided between the upper retaining element 9 and the further retaining element 13 lying thereabove. Preferably, heat insulation 20 is provided between the element 9 and the element 13 in the space 21, such as for example one or more ceramic fiber mats and/or one or more layers of rock wool. In this manner, an undesired heat release upwardly from the flat retaining element 13 can be avoided.

In a further embodiment of the invention (not shown) a further heat retaining element is provided beneath the element 9, preferably parallel to the element 9 with a spacing therebetween. Preferably a heat conduction clement is provided in the air channel between the retaining element 9 and the further element thereunder, which completely or partially fills out the air channel.

The conduction clement preferably has the corrugated structure, forms a plurality of flow channels and preferably is made of sheet metal.

According to another embodiment (not shown) the space 21 does not contain heat insulation, but is filled out completely or partially with a heat conduction element of the described type. A further retaining element (not shown) according to the other embodiment can also be provided.

The retaining elements are preferably formed of steatite. However, other types of refractory materials may be used which have a sufficiently high heat capacity and temperature stability.

Figure 2:
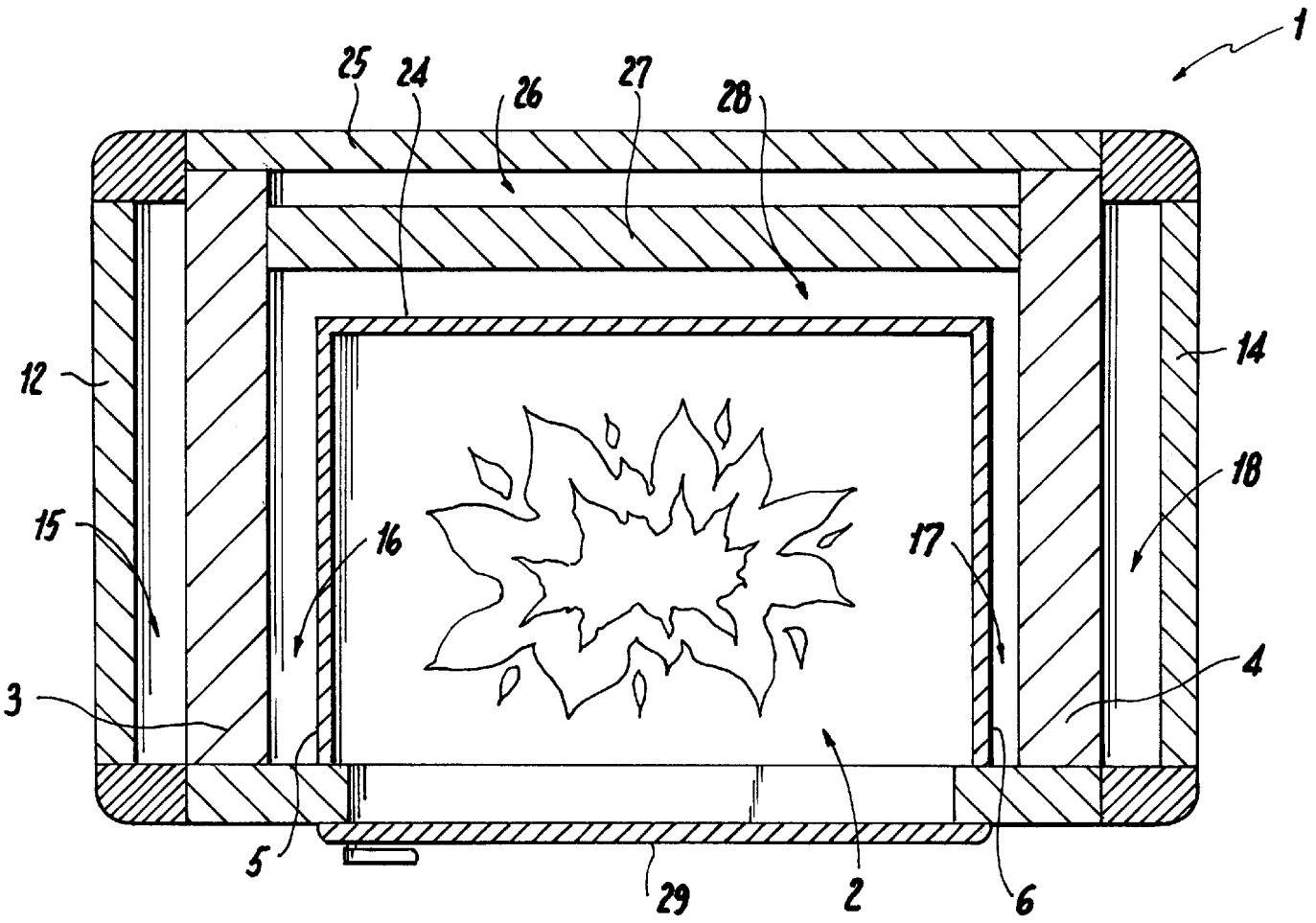
FIG. 2 shows the top view in cross-section of the heating oven of FIG. 1.

FIG. 2 shows a top view in cross-section of the heating oven of FIG. 1. From left to right are shown the left outer retaining element 12, the left outer air channel 15, the left inner retaining element 3, the left inner air channel 16, the left combustion chamber wall 5, the combustion chamber 2, the right wall 6 of the combustion chamber, the right inner air channel 17, the right inner retaining element 4, the right outer air channel 18 and the right outer retaining element 14. As is apparent from FIG. 2, a heat exchanger is formed in analogous manner in the rear region of the oven 1 by means of the back wall 24 of the combustion chamber 2, a rear inner air channel 28, a rear inner retaining element 27, a rear outer air channel 26 and a rear outer retaining element 25. Further, a view window 29 set in a frame is provided on the front side of the combustion chamber 2. A handle or the like is provided on the frame to open the window.

Figure 3:
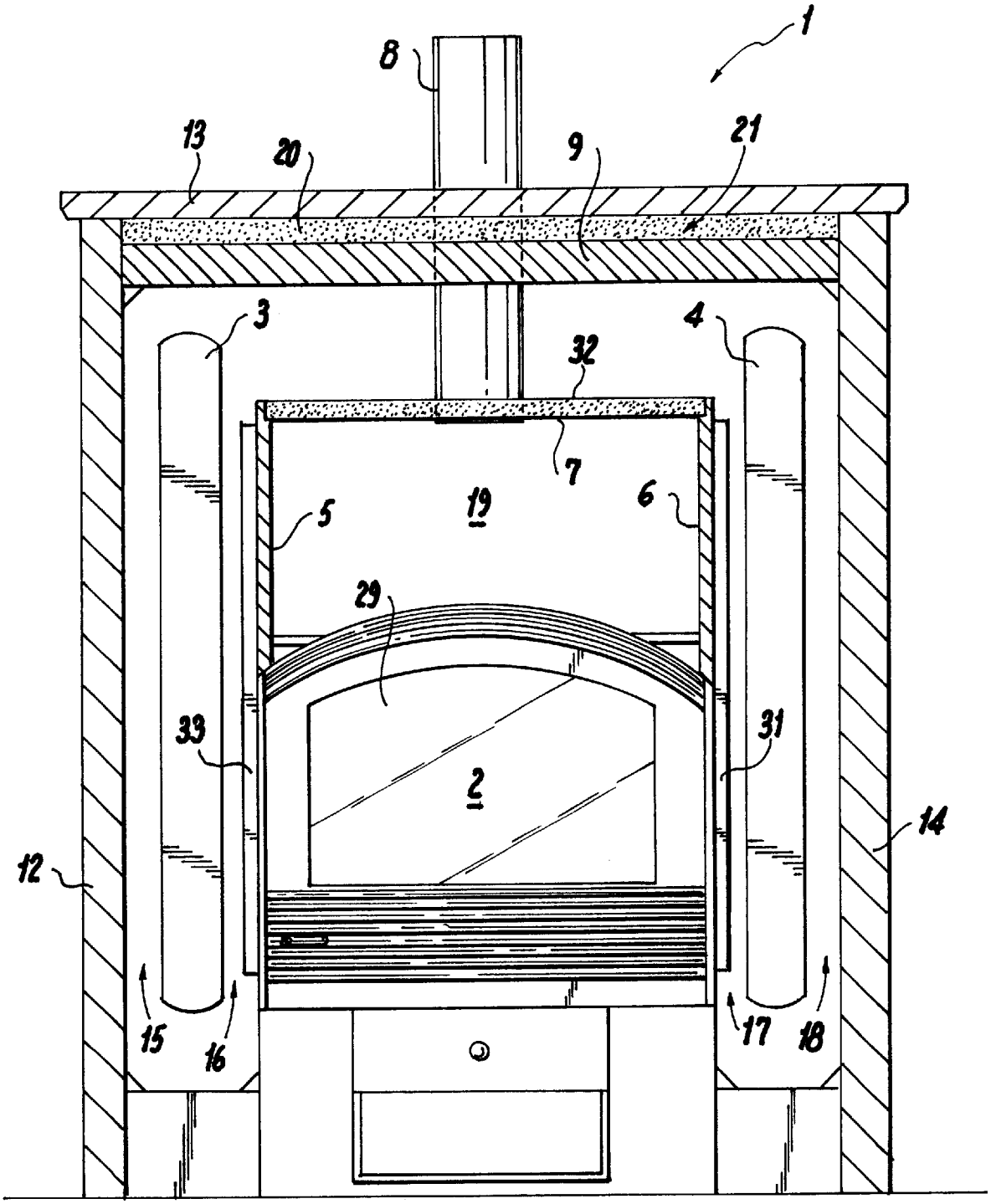
FIG. 3 shows the heating oven of FIG. I with additional heat conduction elements on the walls of the combustion chamber.

A further embodiment of the oven as shown in FIG. 1 is illustrated in longitudinal cross-section in FIG. 3. The walls of the combustion chamber 2 are provided with a left conduction element 33, an upper conduction clement 32 and a right conduction element 31. The heat conduction elements preferably extend over the entire respective wall of the chamber 2 and have a corrugated structure over which the air passes and is heated.

Figure 4:
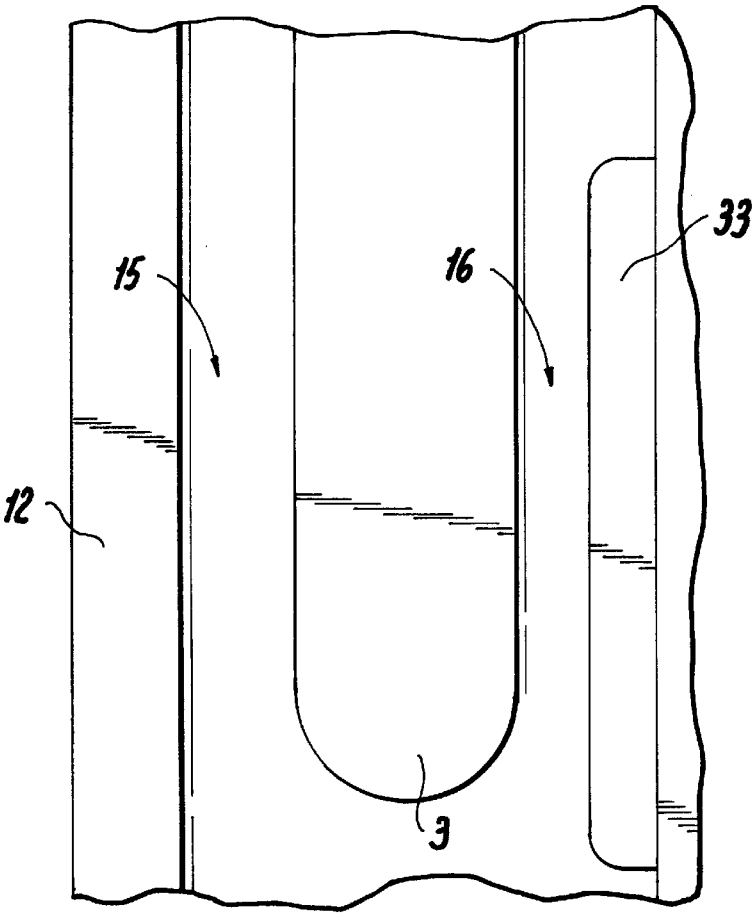

FIG. 4 illustrates an arrangement of the conduction clement 33 shown at the left hand side in FIG. 3 and arranged in the left inner air channel 16. The conduction element 33 preferably takes up substantially half of the spacing between the left wall 5 of the chamber 2 and the inner retaining element 3. Preferably, the inner air channel 16 has a width of about 30 mm, the flat retaining element 3 a thickness of about 50 mm, the left outer air channel 15 a width of about 25 mm and the left outer retaining element 12 a thickness of about 25 mm. To ensure unhindered flow around the retaining clement 3, its upper and lower ends are rounded. The same arrangement is preferably also employed for the vertically arranged walls of the combustion chamber 3.

Figure 5:
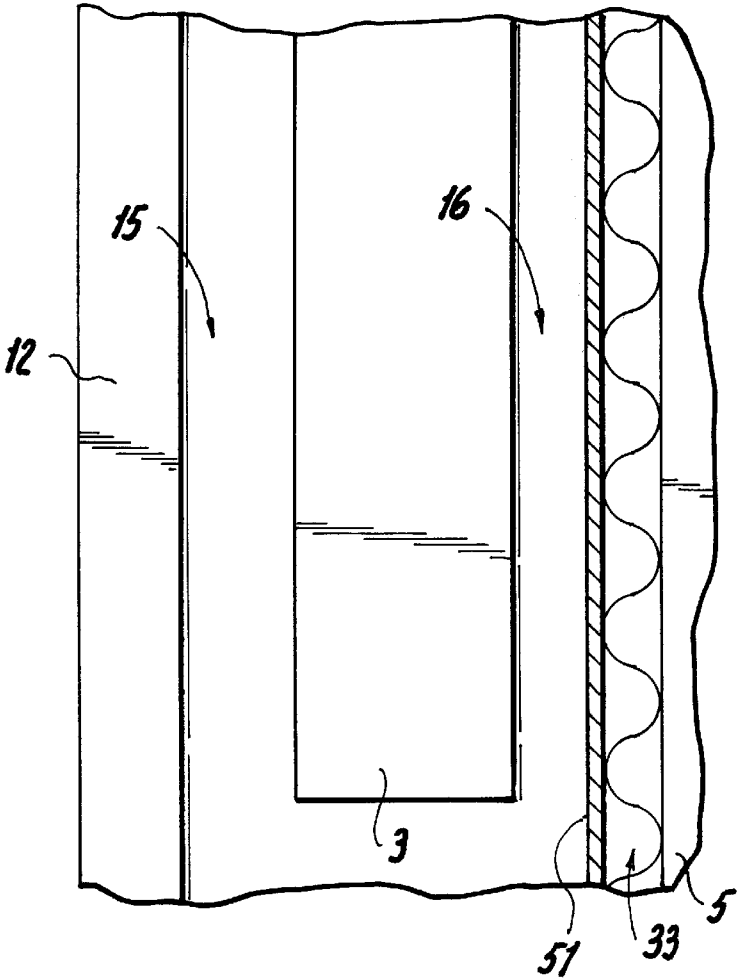
FIGS. 4 and 5 show an arrangement of a heat conduction element in one of the air or flow channels formed between the inside of the retaining element and the wall of the combustion chamber corresponding to FIG. 3.

FIG. 5 illustrates an arrangement corresponding to FIG. 4, in which the conduction element 33 has a corrugated structure. The element 33 is attached to the left wall 5 of the chamber 2 and the corrugated structure runs transverse to the flow direction in the inner air channel 16. The heat conduction element 33 is provided with a conduction plate 51 on the side facing the retaining element 3. It will be understood that a conduction element with a different structure may also be employed. In addition, the heat conduction element can be arranged along the flow direction in the air channel 16 and not transverse thereto. Such an arrangement can also be employed on the other walls of the chamber 2.

Figure 6:
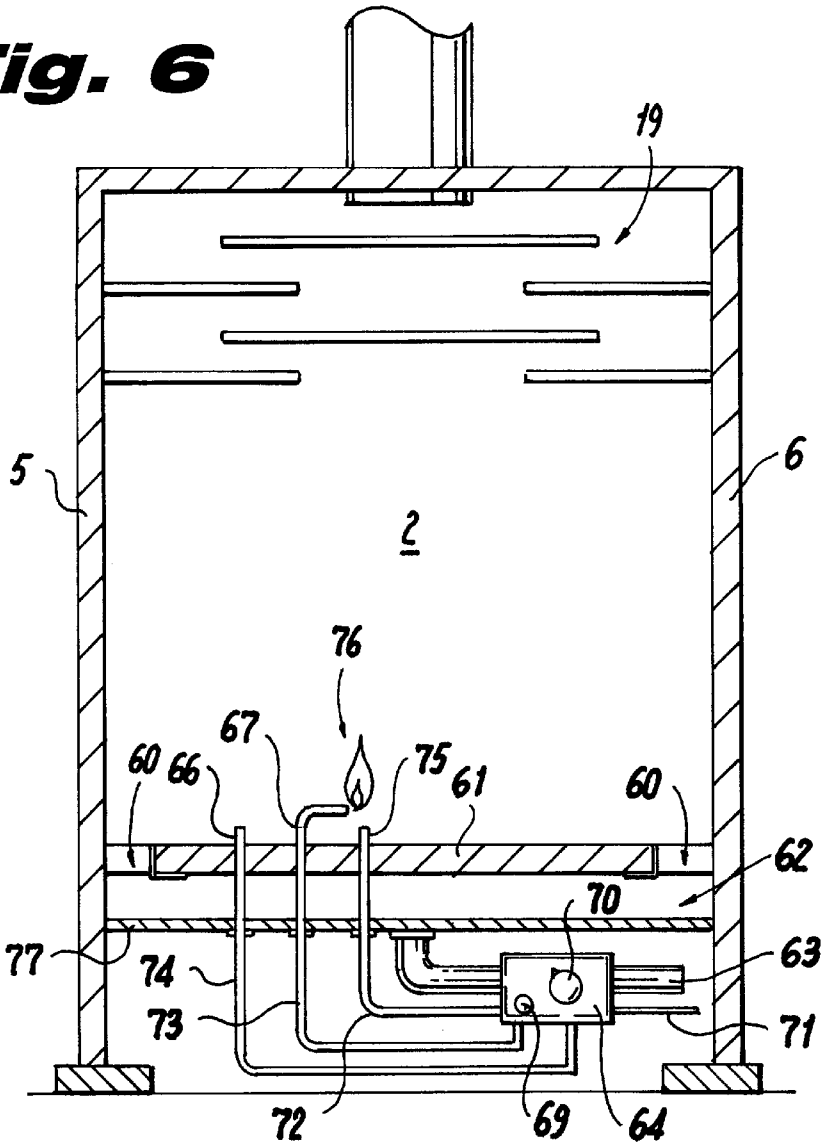
FIG. 6 shows a schematic representation partially in cross-section of a combustion chamber according to the invention tired with natural gas.

FIG. 6 shows a combustion chamber according to the invention for operation with natural gas. A peripheral frame 60 is arranged in its interior at the lower end, which is attached to the inner walls of the chamber 2 and preferably is made of sheet metal. The peripheral frame 60 forms an opening, preferably square or rectangular and carries a gas-permeable plate 61, which for example is made of a suitable porous concrete or any other suitable porous material. Directly beneath the permeable plate 61 is a distribution chamber 62. The upper side of the distribution chamber 62 is defined substantially by the under side of the permeable plate 61 and its lower side is defined by a sheet metal plate which fully closes the combustion chamber at its bottom end. An opening is provided at the under side of the distribution chamber 62, i.e. in the lower sheet metal plate 77. A gas pipe is connected to the opening by means of which gas is fed to the combustion chamber 2 via a gas pipe 63 and a gas valve 64. The gas valve 64 comprises a piezo ignition 69 and an adjustment knob 70 for adjusting the amount of gas supplied to the combustion chamber 2. The piezo ignition 69 is connected to a piezo rod 75 via an electrical wire 72 which preferably passes through the frame 60 tightly on the gas-permeable plate 61 (not shown). The upper end of the piezo rod 75 extends slightly above the gas-permeable plate 61 into the combustion chamber 2. The gas valve 64 also feeds gas via a pipe 73 to a metallic ignition flame tube 67. The flame tube 67 runs approximately parallel to the piezo rod 75 through the frame 60 and its open end extending into the combustion chamber faces the piezo rod 75. Furthermore, a temperature sensor 66, preferably a temperature dependent resistance wire, a bi-metal switch or the like is provided, which is also arranged on the frame 60 and extends slightly into the combustion chamber 2. The temperature sensor is connected via an electrical wire 74 to the gas valve 64.

When starting operation of the present heating oven, gas is supplied via the gas valve or pressure reducer 64 from the gas pipe 63. The valve 64 branches off a portion of the gas to the flame tube 67, where gas is fed into the combustion chamber 2 via its open end. Upon actuation of the piezo ignition 69, an electric spark jumps from the piezo rod 75 to the metallic ignition tube 67 and ignites the gas exiting from the ignition tube 67. An ignition flame results. Subsequently, the gas flow is adjusted by means of the adjustment knob 70 for heating the oven. The gas from the pipe 63 and the valve 64 is fed into the distribution chamber 62 and rises through the gas-permeable plate 61 into the combustion chamber 2, where it is ignited by the ignition flame 76. A flame results over the entire permeable plate, which is highly similar to the flame of a wood fire. The valve 64 determines by means of the temperature sensor 66, preferably time-delayed, whether gas feed to the combustion chamber 2 is followed by a temperature increase at the sensor 66. If not so, this is a sign that uncombusted gas is flowing into the chamber 2. The gas valve 64 then shuts off the gas flow for a predetermined time. After this predetermined time interval, the ignition procedure is re-started.

Alternatively or in addition to the adjustment knob, the gas valve 64 can be connected via an electrical wire 71 to a controller (not shown), which regulates the gas flow to the combustion chamber 2. As an example, the control parameter can be the comparison result between the actual temperature of the room and the predetermined set temperature.

The combustion chamber is preferably made of metal or sheet metal, as shown in FIG. 6, and prefabricated as a module to allow rapid assembly of the present heating oven. Preferably, the prefabricated module or combustion chamber assembly also includes the gas and electrical installations shown in FIG. 6. The retaining elements arc also prefabricated such that the gas pipe 63 and optionally the electrical wire 71 are easily reachable for connection. Preferably, the heat conduction elements are also pre-mounted to the module.

It will be understood that the combustion chamber shown in FIG. 6 for natural gas can be reconfigured in an analogous manner for firing liquid gas or heating oil. When using liquid gas, a gas expansion chamber (not shown) is preferably provided between the gas supply pipe and the distribution chamber to expand the particular gas to a suitable pressure. The gas expansion chamber can also be dispensed with when employing a suitable pressure reducer.

Figure 7:
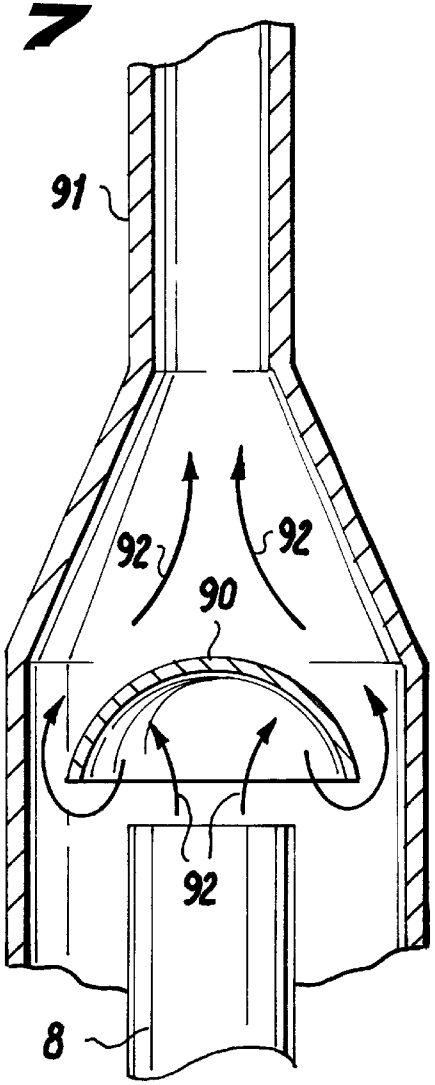
FIG. 7 shows a cross-section in schematic representation of gas flow deflection means for use in a heating oven according to the invention.

The flue gas arrangement shown in FIG. 7 for use with the present heating oven comprises an exhaust tube 8, an approximately semi-spherically shaped shield plate 90, the hollow portion facing the combustion chamber, and a chimney pipe 91, which directs the combustion gases to a chimney. The arrangement shown in FIG. 7 can be located for example directly above the heating oven, in the room, or outside the house. The gas rises in the tube 8, flows against the shield plate 90, flows around the plate and into the chimney pipe 91, as shown by the arrows 92. A particular advantage of the illustrated arrangement is that the shield plate 90 guards against air flowing into the oven from the outside. Thus the extinction of the pilot flame in the oven can be prevented.

A further safety measure of the present heating oven is the prevention of the manually operated view window 29 from being left inadvertently open. If open, uncombusted gas could enter the room or burns could occur, especially when children are present. The view window 29 or the frame carrying the window can be screw connected to the heating oven. A safety catch or the like can also be provided to avoid inadvertent opening of the window. Alternatively, the handle for opening the window can include a lock or the like such that the window can only be opened with a (corresponding) key or with a special tool.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A heating oven having an gas or oil firing system, comprising an air-tight combustion chamber including a fresh air inlet and an exhaust gas outlet, the combustion chamber providing hot air;

at least one heat retaining element spaced apart form the combustion chamber such as to form an air channel between the combustion chamber and the heat retaining element;

the heat retaining element is heated by the hot air form the combustion chamber; and wherein the hot air substantially remains in the heating oven.

2. The heating oven according to claim 1, wherein the combustion chamber is enclosed by a sheet metal mantle.

3. The heating oven according to claim 2, further comprising a combustion controller adapted to open a valve for adjusting the amount of gas and/or oil supplied to the combustion chamber when the temperature falls below a first predetermined value to thereby initiate combustion in the chamber, and adapted to close when a second temperature is reached, thereby shutting down combustion in the chamber.

4. The heating oven according to claim 2, wherein the combustion chamber includes deflection means within the combustion chamber disposed adjacent to the exhaust gas outlet.

5. The heating oven according to claim 4, wherein deflection means provide for multiple deflections of the exhaust gas.

6. The heating oven according to claim 4, wherein the combustion chamber and the means for combustion gas deflection and the heat conduction element are composed of one of metal and refractory brick.

7. The heating oven according to claim 2, wherein the first heat retaining element and the second heat retaining element are arranged substantially parallel to the wall of the combustion chamber and substantially have a dimensions of the corresponding wall of the combustion chamber.

8. The heating oven according to claim 2, wherein the first and heat retaining element comprise several elements.

9. The heating oven according to claim 2, wherein the first and second heat retaining element are substantially flat.

10. The heating oven according to claim 2, wherein the first heat retaining element is rounded at its upper and lower end.

11. The heating oven according to claim 2, wherein the first heat retaining element and the second heat retaining element at least partially comprises a thickness of about 30 mm to 120 mm.

12. The heating oven according to claim 2, wherein the first heat retaining element is thicker than the second heat retaining element.

13. The heating oven according to claim 2, wherein the heating oven comprises at least one temperature sensor connected to the combustion controller via heat resistant electrical wires.

14. The heating oven according to claim 2, wherein the heating oven is provided with electronic simulation means, for simulating cracking and popping sounds of burning wood, comprising a semi-conductor memory for storing a sound sequence, an amplifier and a loud speaker.

15. The heating oven according to claim 2, wherein the at least one heat retaining element includes a side disposed opposite to the combustion chamber and which side is in thermal contact with a second heat retaining element.

16. The heating oven according to claim 15, wherein the at least one heat retaining element has an outer wall and the second heat retaining element has an inner wall and wherein a second flow channel is provided between the outer wall of the at least one heat retaining element and the inner wall of the second heat retaining element.

17. The heating oven according to claim 1, wherein the combustion chamber includes a wall positioned adjacent to the heat retaining element and wherein the combustion chamber wall and the heat retaining element forms the air channel.

18. The heating oven according to claim 1, wherein the air channel is at least partially provided with at least one heat conduction elements.

19. The heating oven according to claim 18, wherein the heat conduction element at least partially comprises a corrugated structure.

20. The heating oven according to claim 19, further providing an air moving from below to above across the heat conduction element.

21. The heating oven according to claim 19, wherein the corrugated structure is arranged in the heating oven such that a plurality of flow channels are formed.

22. The heating oven according to claim 21, wherein the corrugated structure is attached to the combustion chamber.

23. The heating oven according to claim 21, wherein the heat conduction element is at least partially black.

24. The heating oven according to claim 19, wherein the heat conduction element is arranged at a spacing with respect to the first heat retaining element.

25. The heating oven according to claim 24, wherein the heat conduction element comprises a substantially flat plate on the side facing the first heat retaining element.

26. The heating oven according to claim 18, wherein a second heat conduction element is attached to an inner wall of the second heat retaining element.

* * * * *